US010205263B2

(12) United States Patent
Hashimoto

(10) Patent No.: US 10,205,263 B2
(45) Date of Patent: Feb. 12, 2019

(54) CONNECTOR

(71) Applicant: Sumitomo Wiring Systems, Ltd., Yokkaichi, Mie (JP)

(72) Inventor: Tsutomu Hashimoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/765,320

(22) PCT Filed: Sep. 12, 2016

(86) PCT No.: PCT/JP2016/076736
§ 371 (c)(1),
(2) Date: Apr. 2, 2018

(87) PCT Pub. No.: WO2017/056933
PCT Pub. Date: Apr. 6, 2017

(65) Prior Publication Data

US 2018/0287286 A1 Oct. 4, 2018

(30) Foreign Application Priority Data

Oct. 1, 2015 (JP) ..... 2015-195640

(51) Int. Cl.
*H01R 24/00* (2011.01)
*H01R 13/405* (2006.01)
(Continued)

(52) U.S. Cl.
CPC ..... *H01R 13/405* (2013.01); *H01R 13/5202* (2013.01); *H01R 31/06* (2013.01)

(58) Field of Classification Search
CPC ..... H01R 13/405; H01R 13/7137; H01R 12/585; H01R 31/06; H01R 13/5202; G08B 13/1409
See application file for complete search history.

(56) References Cited

U.S. PATENT DOCUMENTS 6,290,239 B1 9/2001 Yoshigi
2016/0006155 A1* 1/2016 Trujillo ..... H01R 12/585 439/78

(Continued)

FOREIGN PATENT DOCUMENTS

JP 09-245880 9/1997
JP 2001-126802 5/2001

(Continued)

OTHER PUBLICATIONS

International Search Report dated Nov. 8, 2016.

*Primary Examiner* — Jean F Duverne

(74) *Attorney, Agent, or Firm* — Gerald E. Hespos; Michael J. Porco; Matthew T. Hespos

(57) ABSTRACT

A connector (10) disclosed by this specification includes a potting material (50), a housing (20) having a recess (21), the potting material (50) being accommodated in the housing (20), a plurality of terminals (40), and a plurality of separation walls (26, 27). The separation walls (26, 27) each located between a pair of adjacent ones of the terminals (40) include passing portions (21B, 21C, 21D) allowing the passage of the potting material (50) at positions deviated from straight lines each connecting a pair of adjacent ones of the terminals (40) when viewed from a projecting direction of the terminals (40), and the passing portions (21B, 21C, 21D) are located closer to the bottom surface (22) of the recess (21) than projecting ends of the separation walls (26, 27).

4 Claims, 7 Drawing Sheets

(51) Int. Cl.
*H01R 13/52* (2006.01)
*H01R 31/06* (2006.01)

(56) References Cited

U.S. PATENT DOCUMENTS

| | | | | |
|---|---|---|---|---|
| 2017/0201049 | A1* | 7/2017 | Shan | H01R 13/7137 |
| 2018/0233006 | A1* | 8/2018 | Koniarek | G08B 13/1409 |

FOREIGN PATENT DOCUMENTS

| | | |
|---|---|---|
| JP | 2010-118231 | 5/2010 |
| JP | 2013-157256 | 8/2013 |

* cited by examiner

CONNECTOR

BACKGROUND

Field of the Invention

This specification relates to a connector.

Description of the Related Art

Japanese Unexamined Patent Publication No. 2013-157256 discloses a relay connector fixed to a case of a differential gear for vehicle through a wall surface from outside and is configured to connect a circuit arranged inside the case and a control circuit outside the case. This relay connector is composed of a connector housing made of synthetic resin, terminal fittings and a potting material. The connector housing includes an outer connector portion open to the outside of a case, an inner connector portion open to the inside of the case and a separation wall disposed between the outer and inner connector portions. The terminal fittings are disposed to penetrate through the separation wall. One end of each terminal fittings projects into the outer connector portion from the separation wall and the other end of each terminal fitting projects into the inner connector portion from the separation wall.

However, in the above relay connector, no interpolar rib is provided between each pair of adjacent terminal fittings. Thus, if a rib is provided between each pair of adjacent terminal fittings as a measure against external matter (to ensure creepage distances) or to prevent collision against the tips of the terminal fittings when the connector is connected, the potting material is made independent for each terminal fitting and the number of times of injection increases, leading to a cost increase. Further, the sizes and shapes of connector housings vary in manufacturing. Thus, the liquid level height of the potting material cannot be made constant merely by making the injection amount of the potting material constant.

SUMMARY

A connector disclosed by this specification has a housing including a recess and a potting material is accommodated in the housing. Terminals project from a bottom surface of the recess, and separation wallsi project from the bottom surface of the recess between the terminals that are adjacent. The separation walls between the adjacent terminals include passing portions allowing the passage of the potting material at positions deviated from straight lines connecting adjacent terminals when viewed from a projecting direction of the terminals. The passing portions are located on parts of the separation walls near the bottom surface of the recess.

According to this configuration, the potting material spreads in the entire recess through the passing portions when the potting material is injected into the recess. Further, since the passing portions are provided at the positions deviated from the straight lines the adjacent terminals when viewed from the projecting direction of the terminals, a creepage distance between each pair of adjacent terminals can be ensured. Thus, even in a state where the respective terminals are separated by the separation walls, it is not necessary to inject the potting material for each terminal. Accordingly, an operation of injecting the potting material can be completed by one injection, and the height of the potting material can be made uniform.

The housing may include a peripheral wall disposed around the recess, and the passing portions may include first passing portions provided between end parts of the separation walls and the peripheral wall. According to this configuration, the potting material can be caused to spread in the entire recess by the first passing portions while the creepage distance between adjacent terminals is ensured.

The housing may include a standing wall projecting from the bottom surface of the recess to a position higher than projecting ends of the terminals, and the passing portions may include second passing portions between end parts of the separation walls and the standing wall. According to this configuration, the potting material can be caused to spread in the entire recess by the second passing portions while the creepage distance between adjacent terminals is ensured. Further, the standing wall prevents a mating connector from contacting and damaging the terminals when the connector is connected to the mating connector.

The passing portions may include a third passing portion disposed between the standing wall and the peripheral wall.

According to this configuration,t the potting material disposed at both sides of the standing wall passes through the third passing portion.

According to the connector disclosed by this specification, it is not necessary to inject the potting material for each terminal after the pairs of adjacent are separated by the separation walls. Thus, the operation of injecting the potting material can be completed by one injection, and the height of the potting material can be made uniform.

DETAILED DESCRIPTION

An embodiment is described below with reference to FIGS. 1 to 7. A connector 10 in this embodiment is mounted into a mounting hole on a transmission case in an automotive transmission. The connector 10 is used to relay and connect a wiring harness disposed outside the transmission case and an electrical component disposed inside the transmission case. Thus, the connector 10 has a function of preventing the entrance of water, external matter and the like into the transmission case from outside and a function of preventing the leakage of oil from the inside to the outside of the transmission case.

Figure 1:
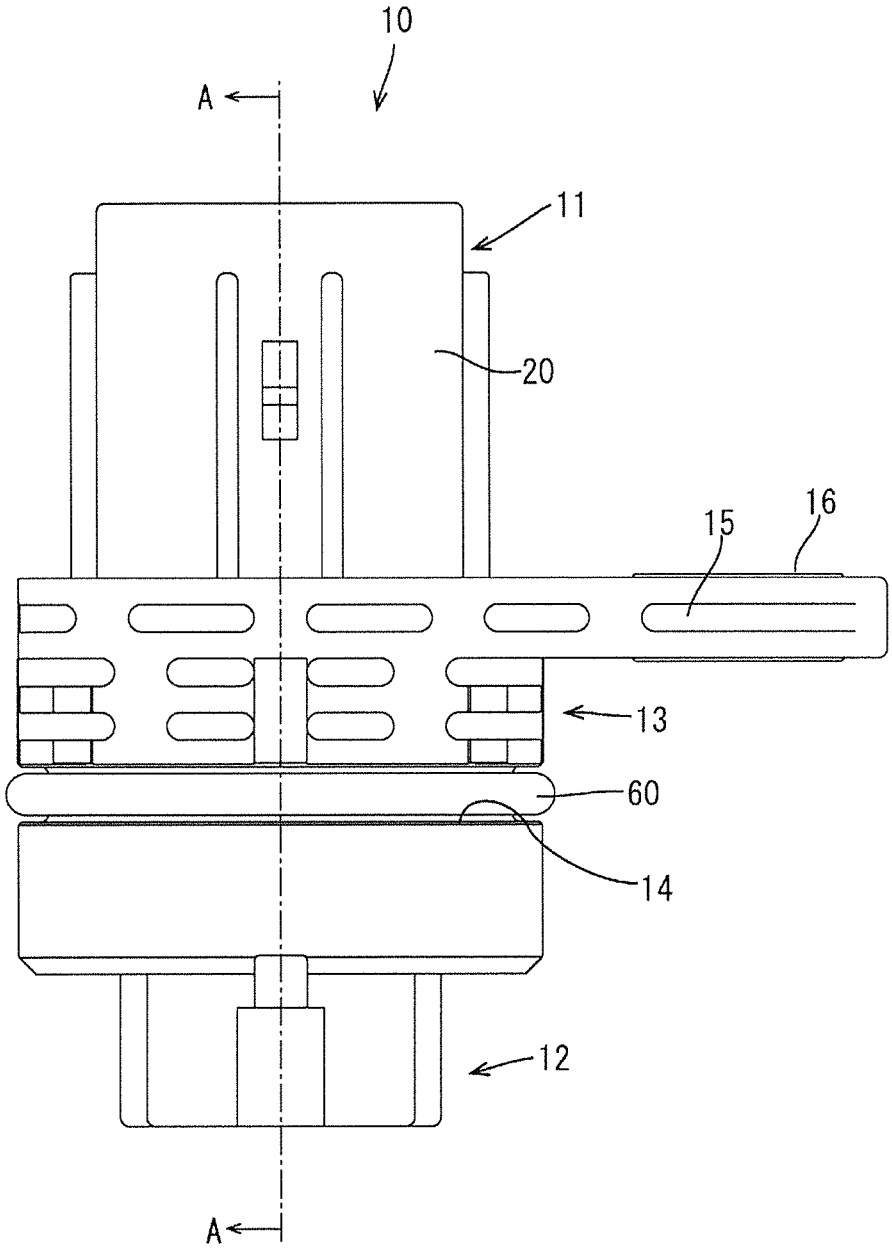
FIG. 1 is a side view of a connector in an embodiment.

As shown in FIG. 1, the connector 10 includes an outer connecting portion 11 for connecting to the wiring harness, an inner connecting portion 12 connecting to the electrical component in the transmission case and a connector body 13 between these connecting portions 11, 12. A rubber ring mounting groove 14 is provided circumferentially in the outer periphery of the connector body 13, and a rubber ring 60 is mounted into the rubber ring mounting groove 14. Further, a mounting flange 15 projects radially on the outer periphery of the connector body 13 and is to be bolted to the transmission case. A metal collar 16 is held on the male terminal fitting 15.

Figure 2:
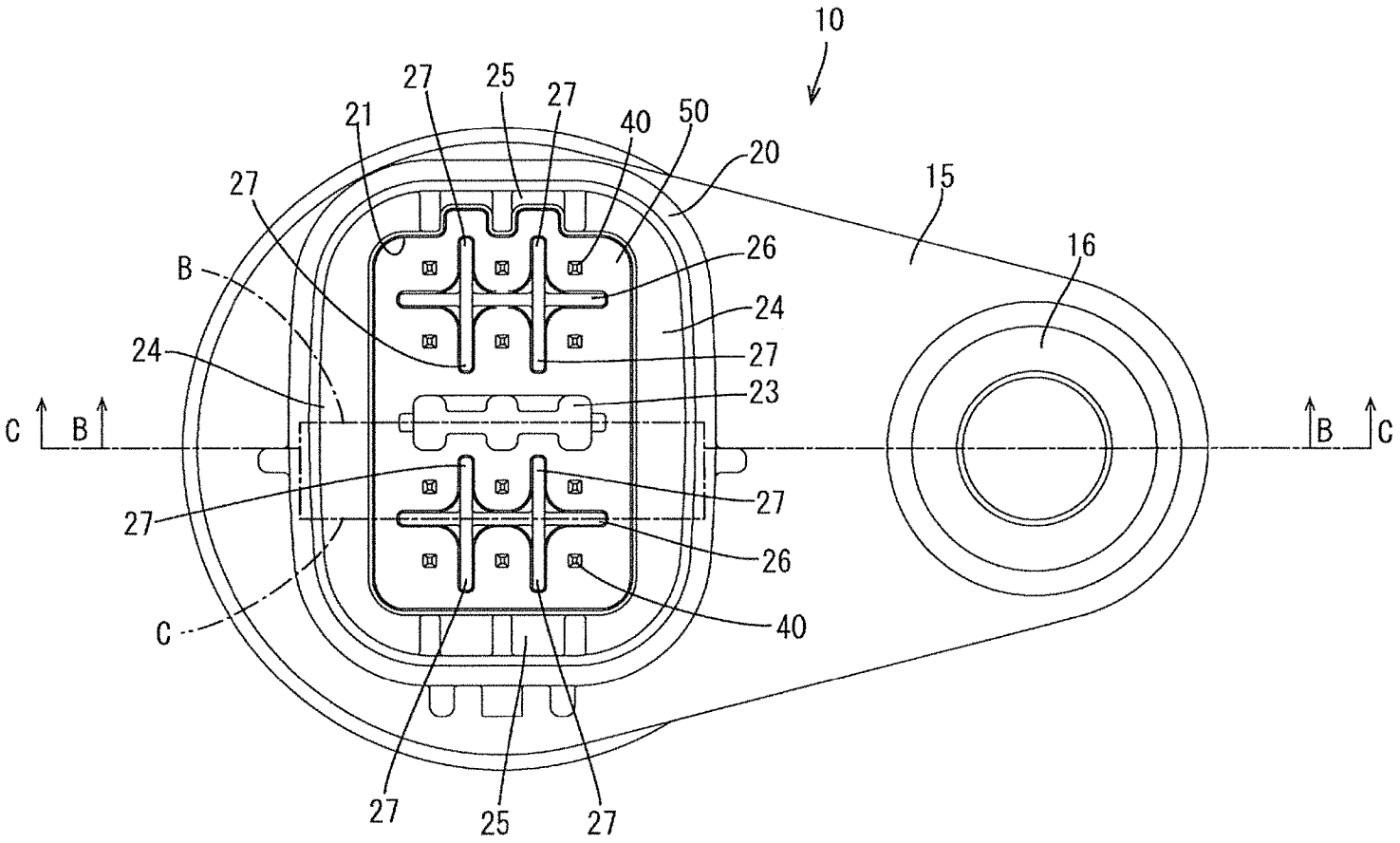
FIG. 2 is a front view of the connector.
Figure 3:
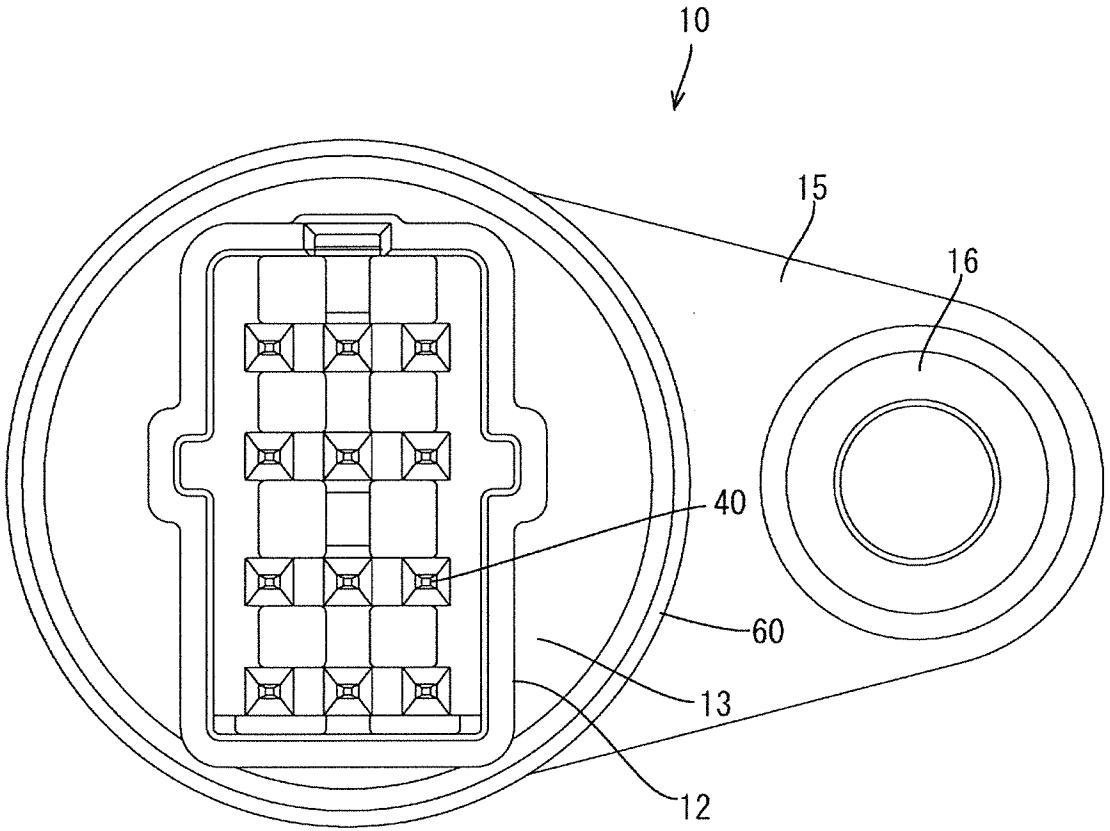
FIG. 3 is a bottom view of the connector.
Figure 4:
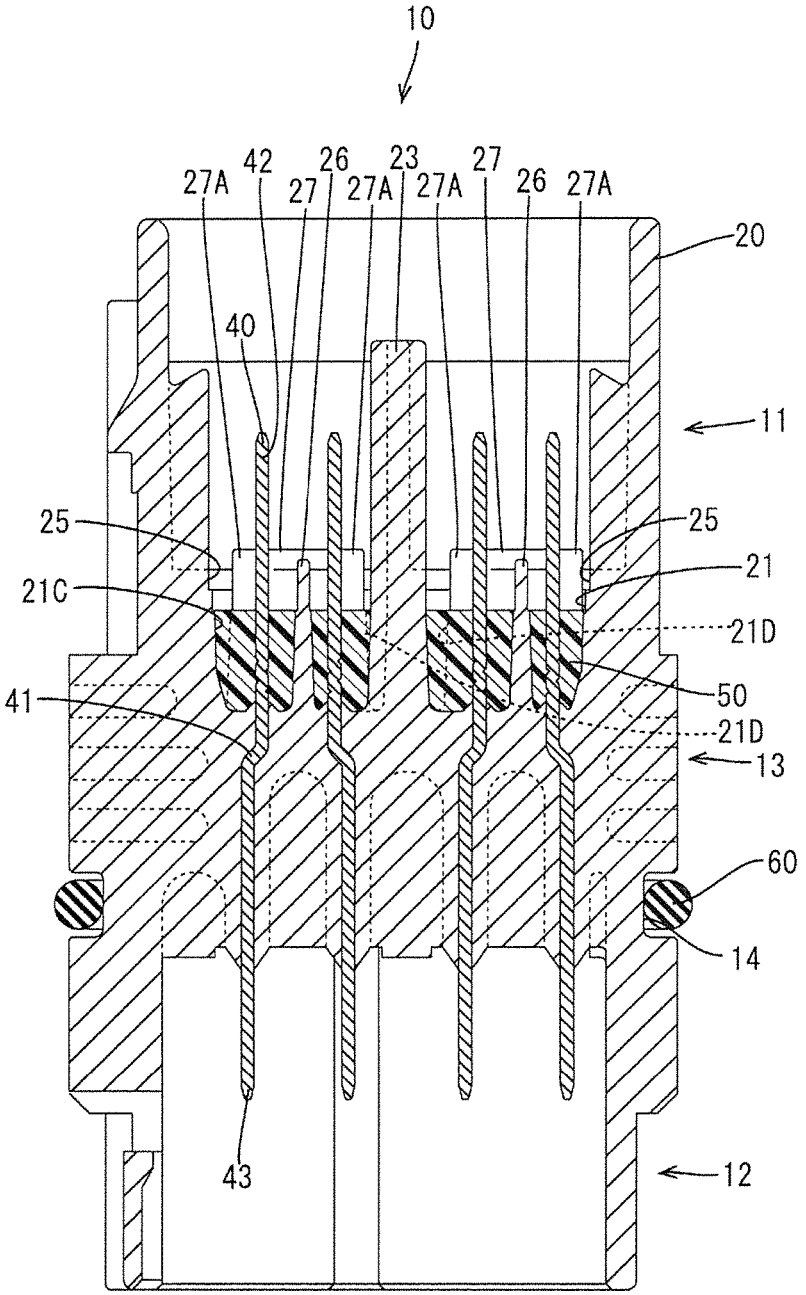
FIG. 4 is a section along A-A in FIG. 1.

As shown in FIGS. 2 to 4, terminals 40 are held in the connector body 13. Each terminal 40 is a needle-like male terminal and is disposed to penetrate through the connector body 13. As shown in FIG. 4, the terminal 40 includes a cranked bent portion 41 that is embedded in the connector body 13 by insert molding. One end part 42 of the terminal 40 projects from the connector body 13 into the outer connecting portion 11 and another end part 43 projects from the connector body 13 into the inner connecting portion 12.

Figure 7:
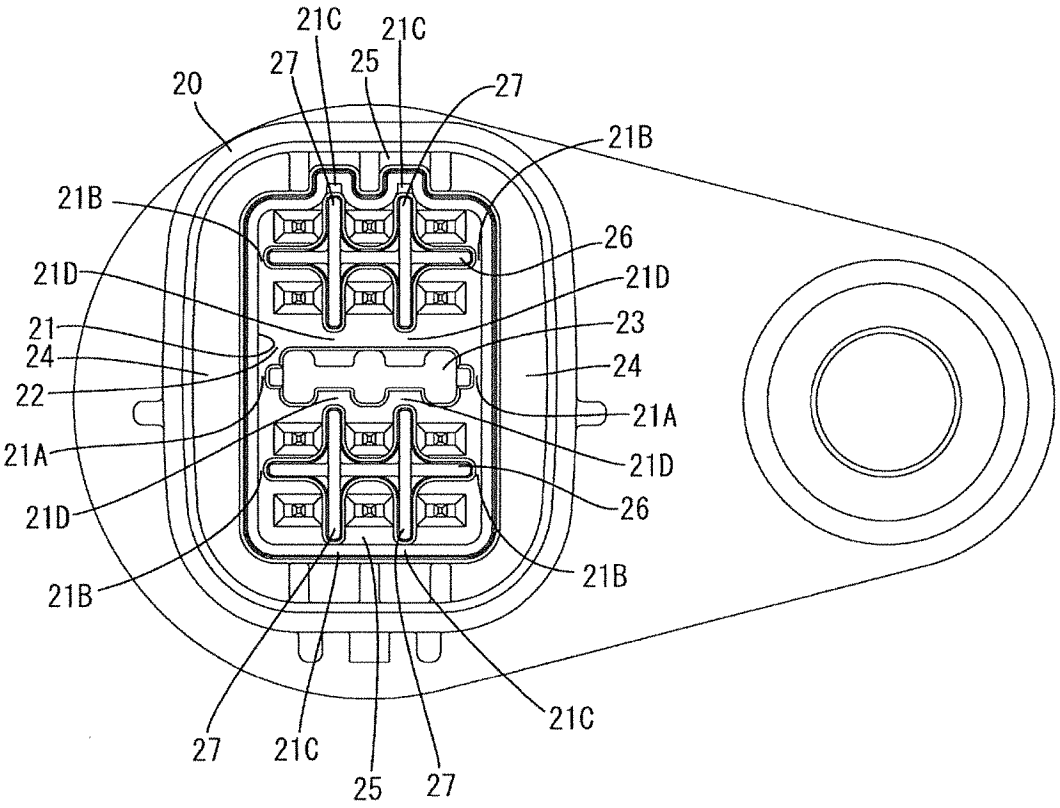
FIG. 7 is a front view of a housing.

As shown in FIG. 7, the outer connecting portion 11 includes a forwardly open receptacle-like housing 20. The housing 20 includes a recess 21 into which a potting material 50 is to be injected, and a standing wall 23 projects forward from a bottom surface 22 of the recess 21 (front surface of the connector body 13). As shown in FIG. 4, the standing wall 23 projects from the bottom surface 22 of the recess 21 to a position higher than the projecting ends of the terminals 40.

As shown in FIG. 7, the recess 21 has a substantially rectangular shape in a front view. Further, the standing wall 23 is located in a center of the recess 21 and disposed along a line (not shown) bisecting the recess 21. A peripheral wall of the recess 21 in the housing 20 is composed of two first peripheral walls 24 disposed at both sides of the standing wall 23 in a long side direction (both left and right sides as shown) and two second peripheral walls 25 disposed at both sides of the standing wall 23 in a short side direction (both upper and lower sides as shown).

Figure 5:
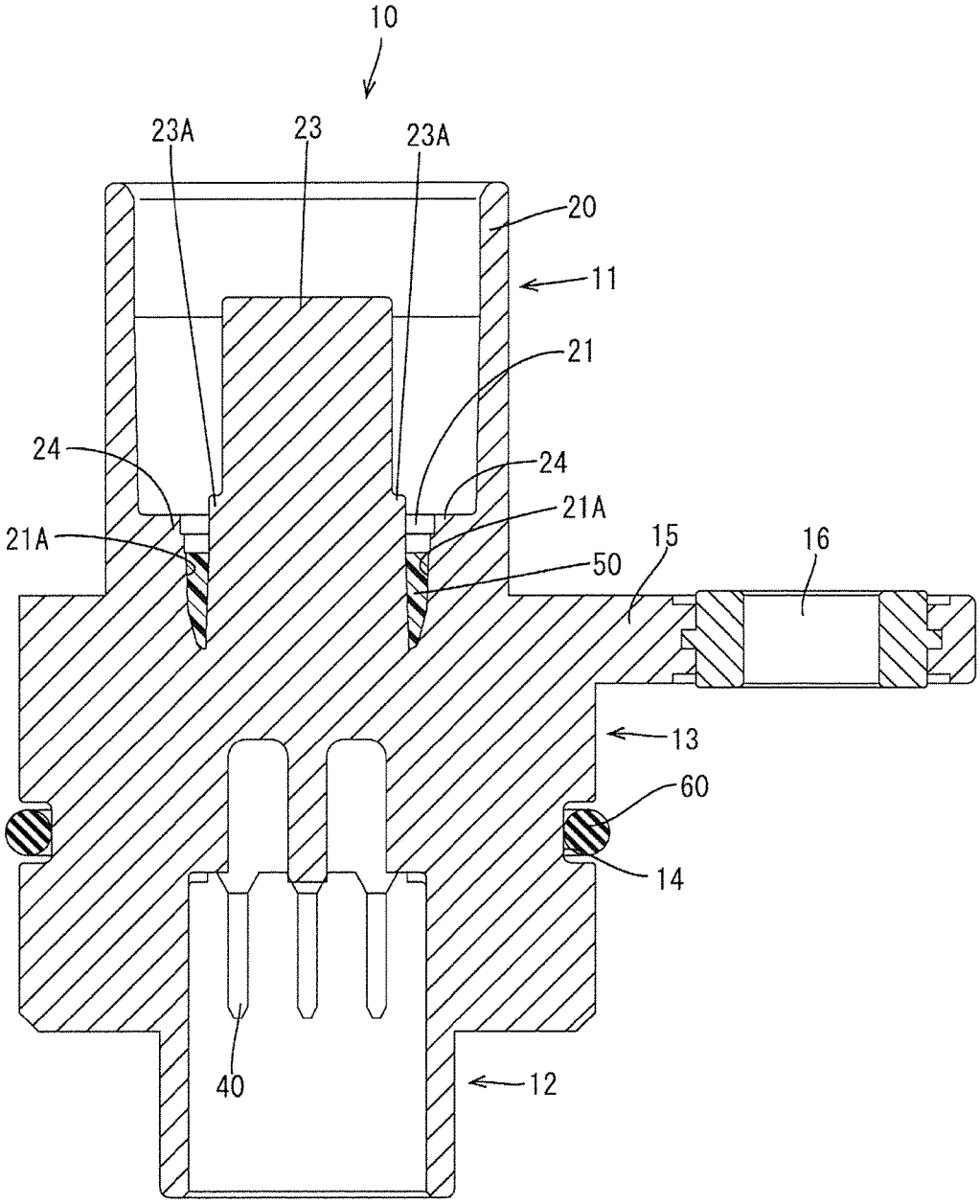
FIG. 5 is a section along B-B in FIG. 2.

The terminals 40 are disposed in an array on each side of the standing wall 23 in the short side direction. As shown in FIGS. 5 and 7, two communication passages 21A are provided between end parts 23A of the standing wall 23 and the first peripheral walls 24 to allow communication between both sides of the standing wall 23 in the short side direction. Further, as shown in FIG. 7, first separation walls 26 extend in the long side direction of the standing wall 23 between the terminals 40 that are adjacent in the short side direction of the standing wall 23 and are lower than the standing wall 23. On the other hand, second separation walls 27 extend in the short side direction of the standing wall 23 between the terminals 40 that are adjacent in the long side direction of the standing wall 23 and are lower than the standing wall 23. As shown in FIG. 4, the first separation walls 26 are slightly lower than the second separation walls 27.

Figure 6:
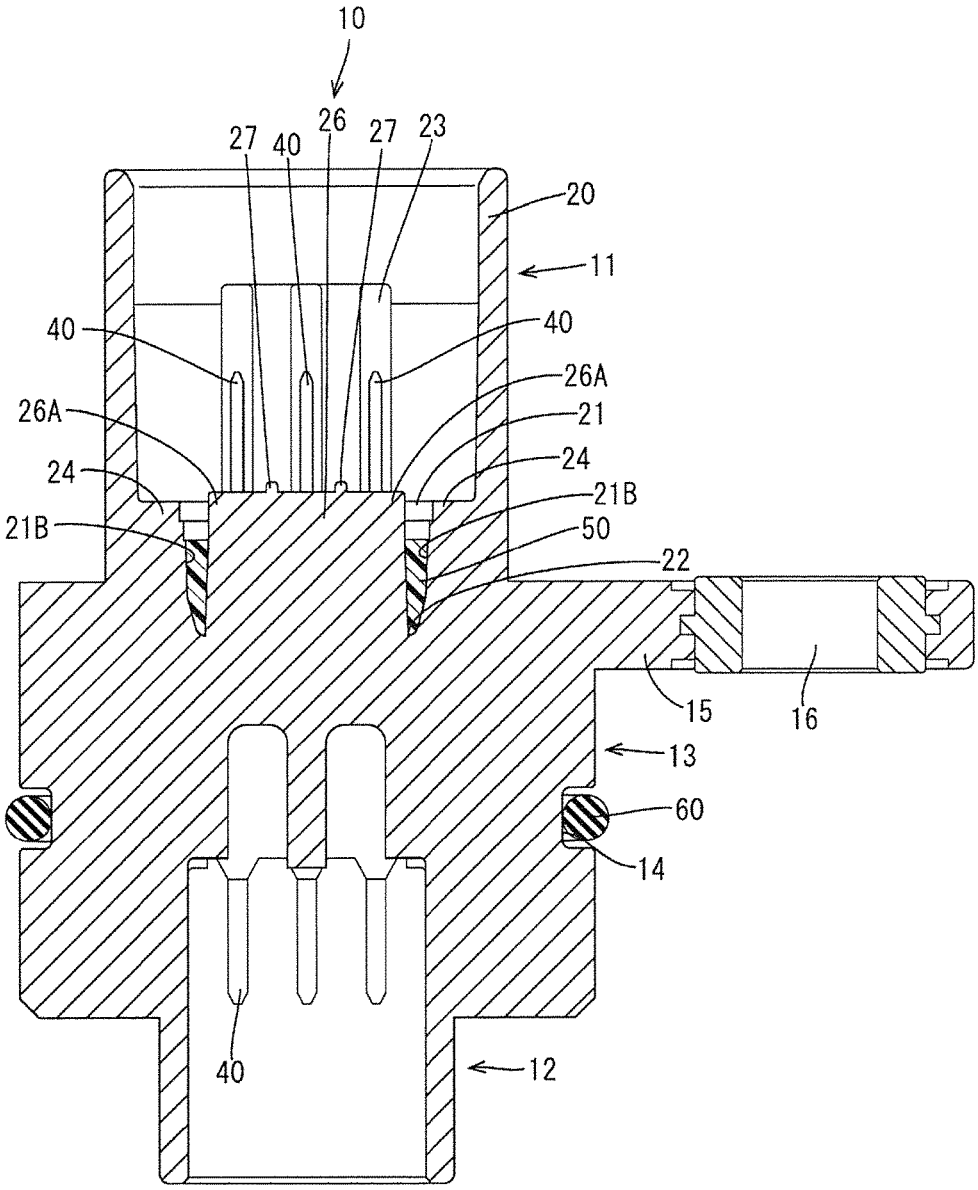
FIG. 6 is a section along C-C in FIG. 2.

As shown in FIG. 6, first passing portions 21B are provided between end parts 26A of the first separation walls 26 and the first peripheral walls 24. Further, as shown in FIG. 4, third passing portions 21C are provided between end parts 27A of the second separation walls 27 and the second peripheral walls 25. Further, as shown in FIG. 7, second passing portions 21D are provided between the end parts 27A of the second separation walls 27 and the standing wall 23. The communication passages 21A and the respective passing portions 21B, 21C and 21D constitute the recess 21. Specifically, since the recess 21 into which the potting material 50 is to be injected is formed into a single space by the respective communication passages 21A and the respective passing portions 21B, 21C and 21D, an operation of injecting the potting material 50 can be completed by one injection and the liquid level height of the potting material 50 can be made uniform.

Further, as shown in FIG. 7, the respective passing portions 21B, 21C and 21D are provided at positions deviated from straight lines connecting adjacent terminals 40 when viewed from a projecting direction of the terminals 40. Thus, a longer creepage distance between adjacent terminals 40 can be ensured as compared to the case where passing portions are provided on straight lines connecting the adjacent terminals 40. Note that central parts of the second separation walls 27 are coupled to the first separation walls 26, and a pair of the second separation walls 27 are disposed at positions symmetrical with respect to the first separation wall 26. In this way, the first separation wall 26 is reinforced by each second separation wall 27 and the tilt of the first separation wall 26 is prevented by each separation wall 27.

The respective communication passages 21A and the respective passing portions 21B, 21C and 21D are provided on parts of the respective separation walls 26, 27 near the bottom surface 22, more specifically provided from the bottom surface 22 of the recess 21 to positions lower than the projecting ends of the respective separation walls 26, 27. Therefore, the projecting ends of the respective separation walls 26, 27 project up from the liquid level of the potting material 50 as shown in FIG. 4. Thus, adjacent terminals 40 are separated by the separation wall 26, 27 projecting from the liquid level of the potting material 50 and a sufficient creepage distance can be ensured between the terminals 40. Further, the respective terminals 40 can be protected by the respective separation walls 26, 27 and the standing wall 23.

As described above, the potting material 50 spreads in the entire recess 21 through the passing portions (passing portions 21B, 21C and 21D) when being injected into the recess 21. Further, since the passing portions are at the positions deviated from the straight lines connecting the adjacent terminals 40 when viewed from the projecting direction of the terminals 40, the creepage distance between adjacent terminals 40 can be ensured. Thus, even in a state where the respective terminals 40 are separated by the separation walls (first separation walls 26, second separation walls 27), it is not necessary to inject the potting material 50 for each terminal 40, an operation of injecting the potting material 50 can be completed by one injection and the height of the potting material 50 can be made uniform.

The housing 20 may include the peripheral wall (first peripheral walls 24) disposed around the recess 21 and the passing portions may include the first passing portions 21B provided between the end parts 26A of the separation walls (first separation walls 26) and the peripheral wall (first peripheral walls 24). According to this configuration, the potting material 50 can be caused to spread in the entire recess 21 by the first passing portions 21B while the creepage distance between adjacent terminals 40 is ensured.

The housing 20 may include the standing wall 23 that projects from the bottom surface 22 of the recess 21 to the position higher than the projecting ends of the terminals 40, and the passing portions may include the second passing portions 21D provided between the end parts 27A of the separation walls (second separation walls 27) and the standing wall 23. According to this configuration, the potting material 50 can be caused to spread in the entire recess 21 by the second passing portions 21D while the creepage distance between adjacent terminals 40 is ensured. Further, the standing wall 23 prevents a mating connector from contacting and damaging the terminals 40 when the connector is connected to the mating connector.

The passing portions may include the third passing portions 21C disposed between the standing wall 23 and the peripheral wall (second peripheral walls 25). According to this configuration, the potting material 50 disposed at both sides of the standing wall 23 can pass through the third passing portions 21C.

The invention is not limited to the above described and illustrated embodiment. For example, the following various modes also are included.

Although the respective passing portions 21B, 21C and 21D are provided over the entire height up to the liquid level of the potting material 50 from the bottom surface 22 of the recess 21 in the above embodiment, passing portions may be provided by cutting parts of the separation walls 26, 27 between the bottom surface 22 of the recess 21 and the liquid level of the potting material 50. Similarly, a passing portion may be provided by cutting a part of the standing wall 23 between the bottom surface 22 of the recess 21 and the liquid level of the potting material 50.

Although the first separation walls 26 and the second separation walls 27 are coupled to each other in the above embodiment, first separation walls and second separation walls may be provided independently.

LIST OF REFERENCE SIGNS

10 . . . connector
20 . . . housing
21 . . . recess
21B . . . first passing portion
21C . . . third passing portion
21D . . . second passing portion
22 . . . bottom surface
23 . . . standing wall
23A . . . end part
24 . . . first peripheral wall
25 . . . second peripheral wall
26 . . . first separation wall
26A . . . end part
27 . . . second separation wall
27A . . . end part
40 . . . terminal
50 . . . potting material

The invention claimed is:

1. A connector, comprising:

a potting material;

a housing including a recess, the potting material being accommodated in the housing;

a plurality of terminals provided to project from a bottom surface of the recess; and a plurality of separation walls provided for each pair of the terminals to project from the bottom surface of the recess between the pair of adjacent ones of the terminals;

wherein the separation walls each located between the pair of adjacent ones of the terminals include passing portions allowing the passage of the potting material at positions deviated from straight lines each connecting a pair of adjacent ones of the terminals when viewed from a projecting direction of the terminals, and the passing portions are located on parts of the separation walls near the bottom surface of the recess.

2. The connector of claim 1, wherein the housing includes a peripheral wall disposed around the recess, and the passing portions include first passing portions provided between end parts of the separation walls and the peripheral wall.

3. The connector of claim 1, wherein the housing includes a standing wall provided to project from the bottom surface of the recess to a position higher than projecting ends of the terminals, and the passing portions include second passing portions provided between end parts of the separation walls and the standing wall.

4. The connector of claim 3, wherein the passing portions include a third passing portion disposed between the standing wall and the peripheral wall.

* * * * *